US007780210B1

(12) United States Patent
Boyum

(10) Patent No.: US 7,780,210 B1
(45) Date of Patent: Aug. 24, 2010

(54) PICKUP BOX RETRIEVAL IMPLEMENT

(76) Inventor: Paul H. Boyum, 19334 Peninsula Trail, Battle Lake, MN (US) 56515

( * ) Notice: Subject to any disclaimer, the term of this patent is extended or adjusted under 35 U.S.C. 154(b) by 389 days.

(21) Appl. No.: 11/366,277

(22) Filed: Mar. 2, 2006

(51) Int. Cl.
*B25J 1/04* (2006.01)

(52) U.S. Cl. ..... 294/19.1; 294/26

(58) Field of Classification Search ..... 294/19.1, 294/24, 26; 410/120, 151; 15/144.4; 172/372
See application file for complete search history.

(56) References Cited

U.S. PATENT DOCUMENTS 4,542,553 A * 9/1985 Cary ..... 294/19.1
4,624,494 A * 11/1986 Huppert ..... 294/19.1
D287,219 S * 12/1986 Smith ..... D8/14
D384,253 S * 9/1997 Patino ..... D8/14
D459,959 S * 7/2002 Fetterman et al. ..... D8/14
D493,680 S * 8/2004 Raymond ..... D8/14
D520,854 S * 5/2006 Barrett ..... D8/307
7,175,201 B2 * 2/2007 Childs et al. ..... 410/120
7,673,912 B2 * 3/2010 Breininger ..... 294/19.1

* cited by examiner

*Primary Examiner*—Paul T Chin
(74) *Attorney, Agent, or Firm*—Marsh Fischmann & Breyfogle LLP

(57) ABSTRACT

An implement (10) for moving a box (48) within a pickup box (42) is disclosed. The implement (10) includes an elongated body (12) having a hooking section (22). A head (28) is associated with an end of this hooking section (22). The head (28) may be disposed within a groove (46) associated with the bed (43) of the pickup box (42), and may be slid along this groove (46) until positioned under the box (48). The implement (10) can then be rotated to engage the head (28) with the underside of the box (48). A user may then pull on the implement (10) to in turn pull the box (48) along the bed (43) of the pickup box (42). The hooking section (22) of the implement may also be disposed behind a box (48) to pull the box (48) to a desired position.

31 Claims, 9 Drawing Sheets

PICKUP BOX RETRIEVAL IMPLEMENT

FIELD OF THE INVENTION

The present invention can be used for retrieving articles from a pickup box and, more particularly, may be in the form of a device or implement that facilitates the retrieval of articles from a pickup box without having to climb up into the pickup box.

BACKGROUND OF THE INVENTION

Pickups are used to transport various types of articles, such as cardboard boxes. Oftentimes an article will occupy a position within the pickup box that will require an individual to climb up into the pickup box in order to retrieve the desired article. While this may be a viable option for some individuals, it is not for others. What would be desirable is an implement that would allow an individual to stand next to the pickup box and retrieve an article that is out of the individual's own personal reach.

SUMMARY OF THE INVENTION

A first aspect of the present invention is generally directed to a method of moving a first object along a surface using an implement having a head. The method includes sliding the implement head along the surface to direct this head underneath the first object. Thereafter the implement may be rotated, which reorients the head to establish a mechanical purchase between the head and the first object or at least brings the head into contact with the first object. Once this engagement is established between the implement head and the first object, the implement may be pulled to in turn move the first object along the surface.

Various refinements exist of the features noted in relation to the first aspect of the present invention. Further features may also be incorporated in the first aspect of the present invention as well. These refinements and additional features may exist individually or in any combination. The first object may be of any appropriate type, such as a cardboard box, a grocery bag, a duffel bag, or a hockey bag. The surface on which the first object is disposed may be of any appropriate type for purposes of the first aspect as well. For instance, the method of the first aspect could be practiced on the cargo bed of a sport utility vehicle. In another embodiment, the surface on which the first object is supported is a bed of a pickup box having a plurality of grooves. The head may be positioned within one of these grooves and slid under the first object. Thereafter, the head may be rotated within this groove to establish a mechanical purchase with the first object, and the head may then be pulled within this groove to pull the first object along the bed of the pickup box at least a certain distance.

The grooves that may be associated with a pickup box in the case of the first aspect may be of any appropriate size, shape, and/or configuration. In one embodiment, the grooves are part of the structure of the bed of the pickup box. Another embodiment has the grooves being part of a separate bedliner that is positioned within the pickup box (e.g., to reduce the potential for scratching the interior of the pickup box). Although the first object may be of any appropriate size, shape, and/or configuration for manipulation by the implement in the case of the first aspect, one preferred configuration for the first object is in the form of a cardboard box or the like.

The engagement of the head with the underside of the first object may be used to pull the first object along the surface and into the desired position in the case of the first aspect. Another option would be to move the first object a certain distance along the surface in the noted manner, to thereafter rotate the implement such that the head may be withdrawn out from under the first object, to thereafter position a hooking section of the implement behind the first object, and to thereafter once again pull on the implement to move the first object further along the surface.

The implement used by the first aspect may include an at least generally T-shaped structure, where the above-noted head defines a distal end of this T-shaped structure. In any case, the head may be sized/configured such that it is totally contained within a groove on the bed of a pickup box when being directed underneath a first object on the bed, and such that it extends up out of this groove when the implement is rotated to bring the head into engagement with the first object. The head may also be characterized as having a thickness that is no more than a depth of a groove in which it may be positioned, as well as a width that is no more than the width of a groove in which it may be positioned, and further where the width of the head is larger than the depth of a groove in which it may be positioned. The head also may be characterized as having a first vertical profile when being positioned under the first object, and may be characterized as having an enhanced or larger second vertical profile after the implement has been rotated to bring the head into engagement with the underside of the first object.

The implement used by the first aspect may include an elongated body, and the head may be disposed beyond an end of this elongated body. The elongated body may be of any appropriate size, shape, and/or configuration (e.g., in the form of a shaped tube), and may be formed from any appropriate material or combination of materials. The head may also be of any appropriate size, shape, and/or configuration (e.g., part of an adaptor that is separately attached to the elongated body, such by having part of the adaptor extend within a hollow interior of this elongated body), and the head may be formed from any appropriate material or combination of materials (e.g., plastic, metal).

The above-noted elongated body that may be used by the first aspect may include a hooking section that is positionable behind the first object. In one embodiment, the head is positioned beyond a sidewall of the hooking section of the elongated body (e.g., in a direction that is orthogonal to a length dimension of this hooking section). Further in this regard, a projection or extension may be positioned opposite of the head (so that the head is positioned beyond the sidewall of the hooking section in one direction, and so that the projection or extension is positioned beyond the sidewall of the hooking section in the opposite direction). This projection or extension provides an enhanced "point contact" or the like if/when the hooking section is positioned behind the first object to pull the same along the surface.

The above-noted elongated body that may be used by the first aspect may include a handle, an intermediate section, and a hooking section, with the head being spaced from the hooking section and where the intermediate section structurally interconnects the handle with the hooking section. Consider the case where the handle and the head are spaced in the length dimension, and where a lateral dimension is orthogonal to this length dimension. The position of the handle in the lateral dimension may be between the position of the head in the lateral dimension and the position of at least part of the intermediate section in the lateral dimension. In one embodiment, the intermediate section is in the form of first and second intermediate sections, with the first intermediate section extending at an angle from the handle and with the second intermediate section interconnecting the hooking section and the first intermediate section. In this regard: 1) the angle between the hooking section and the second intermediate section may be less than 90° (e.g., about 85°); 2) the handle may be parallel with the second intermediate section; and 3) the handle may be disposed at an angle of 10° or less relative to a reference axis that is parallel with the second intermediate section.

A first axis may be associated with the implement used by the first aspect, and this first axis may coincide with a length dimension of the implement. The above-noted elongated body may include what may be characterized as a handle, an intermediate section, and a hooking section. The intermediate section may extend from the handle and at least initially away from the noted first axis such that the intermediate section is disposed on a first side of this first axis, the intermediate section may structurally interconnect the handle and the hooking section, the head may be disposed on a second side of the first axis (i.e., the intermediate section and the head may be characterized as being disposed on opposite sides of the noted first axis), and the handle may be located somewhere between the intermediate section and the head in a lateral dimension that is orthogonal to the first axis. Stated another way, the handle may be characterized as being offset from each of the head and the intermediate section in a dimension that is orthogonal to the noted first axis. In any case and with further regard to the noted configuration of the elongated body: 1) the hooking section may be disposed at least substantially orthogonal or transversely to the first axis; 2) the head and the handle may be offset by a distance within a range of about 2 inches to about 5 inches, measured in the noted lateral dimension; 3) the implement may be characterized as further including a neck that extends from the noted hooking section, where the head is disposed on an end of this neck, and where the head is wider than this neck; and 4) the implement may be characterized as further including a neck that extends from the noted hooking section, where the head is disposed on an end of this neck, and where the head is disposed at least substantially transversely relative to this neck.

A second aspect of the present invention is generally directed to an implement that may be used to move a first object. This implement includes an elongated body and a head. The elongated body includes a hooking section, and the head is disposed beyond an end of this hooking section.

Various refinements exist of the features noted in relation to the second aspect of the present invention. Further features may also be incorporated in the second aspect of the present invention as well. These refinements and additional features may exist individually or in any combination. The first object may be of any appropriate type, such as a cardboard box, a grocery bag, a duffel bag, or a hockey bag. The surface on which the first object is disposed may be of any appropriate type for purposes of the second aspect as well. For instance, the implement of the second aspect could be used to move a first object on the cargo bed of a sport utility vehicle. In another embodiment, the surface on which the first object is supported is a bed of a pickup box having a plurality of grooves. The head may be positioned within one of these grooves and slid under the first object. Thereafter, the head may be rotated within this groove to establish a mechanical purchase with the first object, and the head may then be pulled within this groove to pull the first object along the bed of the pickup box at least a certain distance.

The grooves that may be associated with a pickup box referenced in the case of the second aspect may be of any appropriate size, shape, and/or configuration. In one embodiment, the grooves are part of the structure of the bed of the pickup box. Another embodiment has the grooves being part of a separate bedliner that is positioned within the pickup box (e.g., to reduce the potential for scratching the interior of the pickup box). Although the first object may be of any appropriate size, shape, and/or configuration for manipulation by the implement in the case of the second aspect, one preferred configuration for the first object is in the form of a cardboard box or the like.

The implement of the second aspect may include an at least generally T-shaped structure, where the above-noted head defines a distal end of this T-shaped structure. In any case, the head may be sized/configured such that it is totally contained within a groove on the bed of a pickup box when being directed underneath a first object on the bed, and such that it extends out of this groove when the implement is rotated to bring the head into engagement with the first object. The head may also be characterized as having a thickness that is no more than a depth of a groove in which it may be positioned, as well as a width that is no more than the width of a groove in which it may be positioned, and further where the width of the head is larger than the depth of a groove in which it may be positioned. The head also may be characterized as having a first vertical profile when being positioned under the first object, and may be characterized as having an enhanced or larger second vertical profile after the implement has been rotated to bring the head into engagement with the underside of the first object when in the pickup box.

The elongated body of the implement of the second aspect may be of any appropriate size, shape, and/or configuration (e.g., in the form of a shaped tube), and may be formed from any appropriate material or combination of materials. The head may also be of any appropriate size, shape, and/or configuration (e.g., part of an adaptor that is separately attached to the elongated body, such by having part of the adaptor extend within a hollow interior of this elongated body), and the head may be formed from any appropriate material or combination of materials (e.g., plastic, metal).

The above-noted elongated body that may be used by the second aspect may include a hooking section that is positionable behind the first object. In one embodiment, the head is positioned beyond a sidewall of the hooking section of the elongated body (e.g., in a direction that is orthogonal to a length dimension of this hooking section). Further in this regard, a projection or extension may be positioned opposite of the head (so that the head is positioned beyond the sidewall of the hooking section in one direction, and so that the projection or extension is positioned beyond the sidewall of the hooking section in the opposite direction). This projection or extension provides an enhanced "point contact" or the like if/when the hooking section is positioned behind the first object to pull the same along the surface.

The elongated body of the implement of the second aspect may include a handle, an intermediate section, and a hooking section, with the head being spaced from the hooking section and where the intermediate section structurally interconnects the handle with the hooking section. Consider the case where the handle and the head are spaced in the length dimension, and where a lateral dimension is orthogonal to this length dimension. The position of the handle in the lateral dimension may be between the position of the head in the lateral dimension and the position of at least part of the intermediate section in the lateral dimension. In one embodiment, the intermediate section is in the form of first and second intermediate sections, with the first intermediate section extending at an angle from the handle and with the second intermediate section interconnecting the hooking section and the first intermediate section. In this regard: 1) the angle between the hooking section and the second intermediate section may be less than 90° (e.g., about 85°); 2) the handle may be parallel with the second intermediate section; and/or 3) the handle may be disposed at an angle of 10° or less relative to a reference axis that is parallel with the second intermediate section.

A first axis may be associated with the implement of the second aspect, and this first axis may coincide with a length dimension of the implement. The elongated body may include what may be characterized as a handle, an intermediate section, and a hooking section. The intermediate section may extend from the handle and at least initially away from the noted first axis such that the intermediate section is disposed on a first side of this first axis, the intermediate section may structurally interconnect the handle and the hooking section, the head may be disposed on a second side of the first axis (i.e., the intermediate section and the head may be characterized as being disposed on opposite sides of the noted first axis), and the handle may be located somewhere between the intermediate section and the head in a lateral dimension that is orthogonal to the first axis. Stated another way, the handle may be characterized as being offset from each of the head and the intermediate section in a dimension that is orthogonal to the noted first axis. In any case and with further regard to the noted configuration of the elongated body: 1) the hooking section may be disposed at least substantially orthogonal or transversely to the first axis; 2) the head and the handle may be offset by a distance within a range of about 2 inches to about 5 inches, measured in the noted lateral dimension; 3) the implement may be characterized as further including a neck that extends from the noted hooking section, where the head is disposed on an end of this neck, and where the head is wider than this neck; and 4) the implement may be characterized as further including a neck that extends from the noted hooking section, where the head is disposed on an end of this neck, and where the head is disposed at least substantially transversely relative to this neck.

A third aspect of the present invention is generally directed to a method of moving a first object within a pickup box using an implement in the form of a shaped tube having a hooking portion and a handle that are located at least generally at opposite ends of the implement. A user grabs the handle and positions the hooking section behind a first object that is within the pickup box, and thereafter pulls on the implement to move the first object along a bed of the pickup box. The various features discussed above in relation to the first and second aspects may be used by this third aspect, individually or in any combination.

A fourth aspect of the present invention is generally directed to a method of moving a first object within a pickup box using an implement in the form of an at least generally L-shaped tube. A user grabs one end of the implement and positions the opposite end of the implement behind a first object that is within the pickup box, and thereafter pulls on the implement to move the first object along a bed of the pickup box. The various features discussed above in relation to the first and second aspects may be used by this fourth aspect, individually or in any combination.

A fifth aspect of the present invention is generally directed to an implement that may be used to move a first object. The implement is in the form of an elongated body (e.g., a shaped tube) having a handle, a first intermediate section, a second intermediate section, and a hooking section. The first intermediate section is disposed between the second intermediate section and the handle. The second intermediate section is disposed between the hooking section and the second intermediate section. The angle between the hooking section and the second intermediate section is less than 90°. The handle is disposed at an angle relative to a reference axis that is parallel with the second intermediate section. In one embodiment, the handle angle is greater than 0°, but is no more than about 10°.

DETAILED DESCRIPTION

Figure 1:
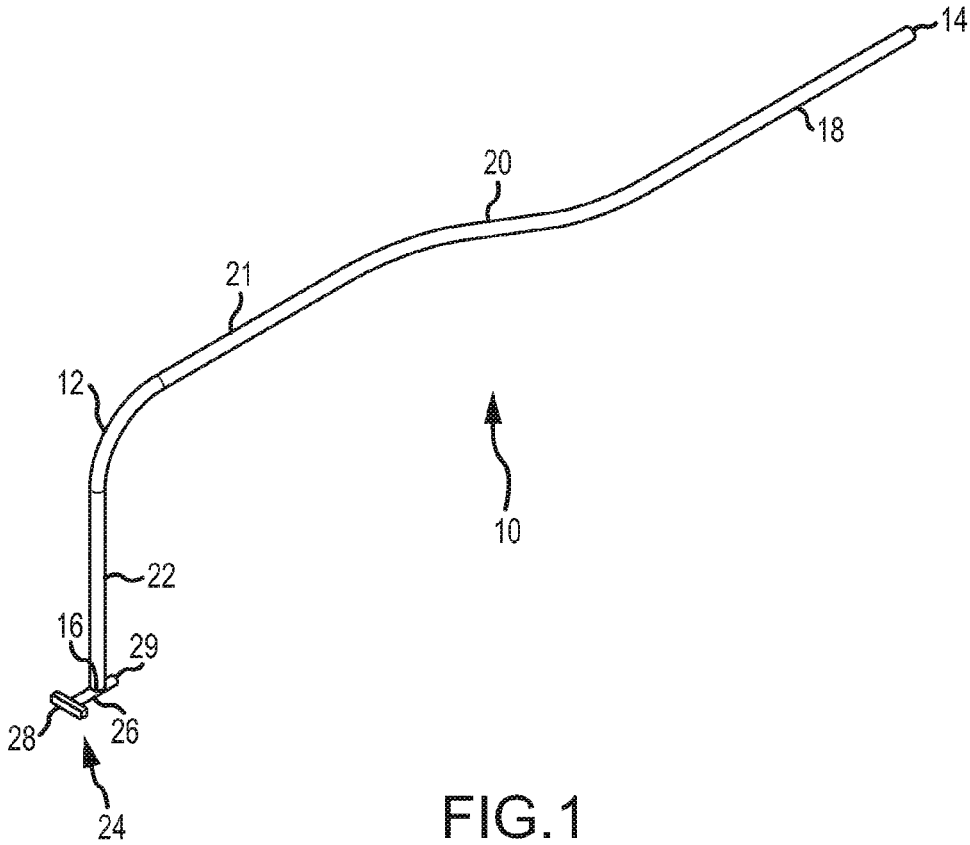
FIG. 1 is a perspective view of one embodiment of an implement that may be used to retrieve articles from a pickup box.
Figure 2A:
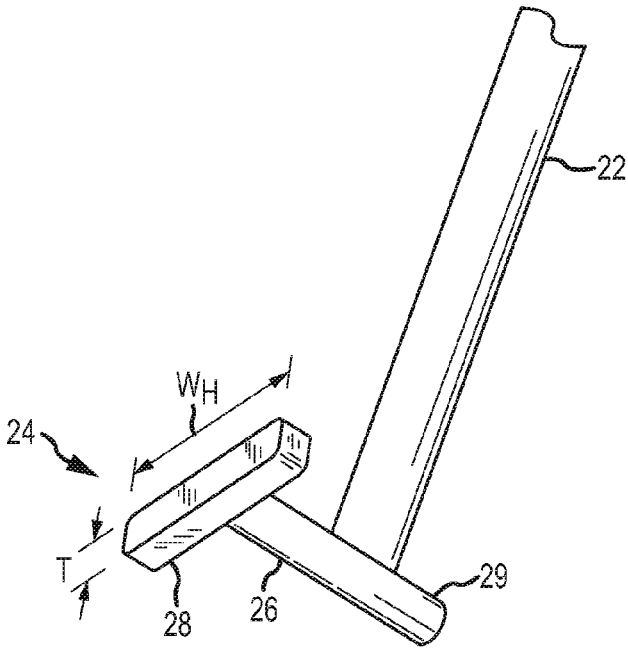
FIG. 2A is an enlarged, perspective view of the head used by the implement of FIG. 1 (and which also may be used by the implement of FIG. 6).
Figure 2B:
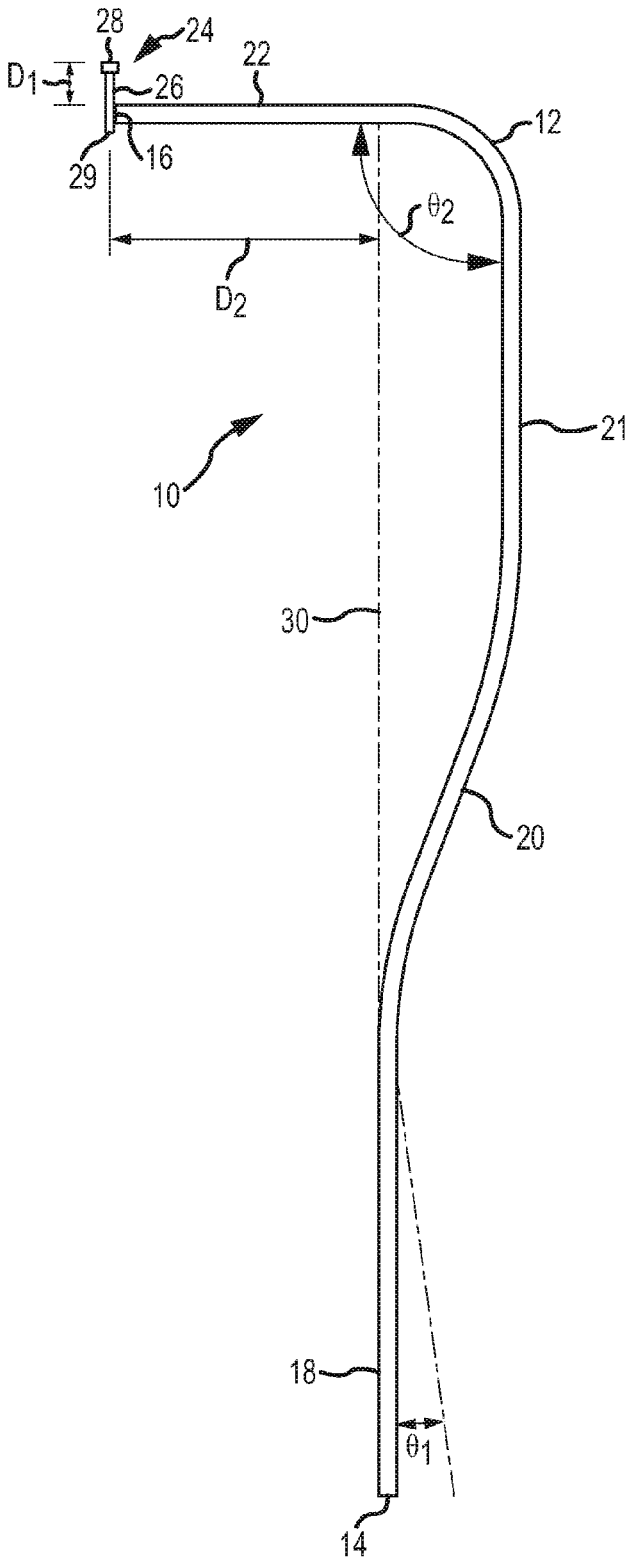
FIG. 2B is a side view of the implement of FIG. 1, with the implement being in a prone position.

FIGS. 1, 2A, and 2B illustrate what may be characterized as a device or implement 10 for retrieving/moving articles (e.g., articles within a pickup box). The implement 10 includes what may be characterized as an elongated body 12 and a head 28. Generally, the elongated body 12 in effect extends the reach of an individual into a pickup box, while the head 28 may be used to move articles within a pickup box in cases where it may not be possible/convenient to dispose an end portion of the elongated body 12 behind an article in the pickup box. In one embodiment, the elongated body 12 is in the form of a shaped tube (e.g., a hollow structure of an appropriate shape, such as cylindrical) and the head 28 is part of a plug, adaptor, or insert 24 that is mounted within an open end of this shaped tube of the elongated body 12. However, the elongated body 12 and the head 28 could be integrally formed, or the head 28 could be separately attached to the elongated body 12 in any appropriate manner. Moreover, each of the elongated body 12 and the head 28 may be formed from any appropriate material or combination of materials, and further may be of any appropriate size, shape, and/or configuration. In one embodiment: 1) the elongated body is in the form of a shaped metal tube (e.g. aluminum), and the exterior of which may be treated as desired/required (e.g., powder coated); and 2) the adaptor 24 is an integral or unitary structure formed from an appropriate material (e.g., injection molded nylon of an appropriate strength). However, the adaptor 24 could be a multi-piece structure, where the individual pieces are separately attached to each other in any appropriate manner as well.

The elongated body 12 is at least generally L-shaped, and includes a first end 14 and a second end 16 that are spaced along a reference axis 30. The distance between the first end 14 and the second end 16 of the elongated body 12, measured along the reference axis 30, coincides with a length dimension of the implement 10. The implement 10 may be of any appropriate length, with the majority of its length typically being defined by the elongated body 12.

The elongated body 12 of the implement 10 is shaped to facilitate being able to use the implement 10 to pull an article along a bed of pickup box or along any other appropriate surface (e.g., the cargo area of a sport utility vehicle). In this regard, the elongated body includes a handle 18 that extends along the reference axis 30 in the illustrated embodiment (although it may be disposed at an angle relative to this axis 30 as will be discussed below in relation to FIG. 6), a first intermediate section 20 that extends from the handle 18 and at least initially away from the reference axis 30, a second intermediate section 21 that is parallel with the reference axis 30, and a hooking section 22. The first end 14 of the elongated body 12 is associated with a free end of the handle 18, the intermediate sections 20, 21 are disposed on one side of the reference axis 30, the second end 16 is associated with a free end of the hooking section 22, and the second end 16 is disposed on an opposite side of the reference axis 30 compared to the intermediate sections 20, 21 (see FIG. 2B). The hooking section 22 is at least generally transversely disposed relative to the reference axis 30 in the illustrated embodiment. More generally, the hooking section 22 should be sized and/or shaped so as to be positionable behind an article such that the implement 10 can thereafter be pulled, to in turn pull the article along the requisite surface. Another characterization of the elongated body 12 is that a position of the handle 18 in a lateral dimension (the lateral dimension being orthogonal to the length dimension of the implement 10 that corresponds with the reference axis 30) is between a position of the end 16 of the hooking section 22 in the lateral dimension and a position of at least part of the intermediate section 21 in the lateral dimension.

The elongated body 12 may be shaped to facilitate using the implement 10 to retrieve an article. At least with regard to the pickup box retrieval application, it may be desirable for the handle 18 to be disposed at an angle ($\theta_1$ in FIG. 2B) relative to the reference axis 30. In one embodiment, this angle $\theta_1$ is greater than 0° and is no more than about 10°. FIG. 2B illustrates that the hooking section 22 and the second intermediate section 21 of the elongated body 12 are separated by an angle $\theta_2$. The angle $\theta_2$ is about 90° in the illustrated embodiment. However, having the angle $\theta_2$ be less than 90° (see FIG. 6) focuses the application of a force onto the article being retrieved using the implement 10. In one embodiment, the angle $\theta_2$ is about 85°.

The head 28 is associated with the second end 16 of the elongated body 12 or its hooking section 22, is disposed beyond the hooking section 22 (more specifically beyond a sidewall of the hooking section 22), and defines a distal end of the implement 10. Stated another way, the head 28 defines a leading portion of the implement 10 when moving the implement 10 to dispose the head 28 under an article in a manner that will be discussed in more detail below. The head 28 may be integrated with the elongated body 12 in any appropriate manner. In one embodiment, the head 28 is part of an adaptor or insert 24 that is mounted within an end of a hollow interior of the elongated body 12. The adaptor 24 includes a neck or extension 26 that may extend at least generally parallel to the reference axis 30, but in any case extends beyond the hooking section 22 of the elongated body 12. The head 28 is disposed on an end of the neck 26, and is thereby spaced from the hooking section 22 of the elongated body 12. That is, the head 28 is spaced from the hooking section 22 of the elongated body 12 by the neck 26 of the adaptor 24 so as to define a distal end of the implement 10.

The head 28 of the implement 10 may be characterized as being part of an at least generally T-shaped structure (the neck 26 defining the "long leg" of the T-shaped structure, and the head 28 defining the "cross leg" of the T-shaped structure). The head 28 is subject to a number of other characterizations. One is that the head 28 is wider than the neck 26. Another is that the head 28 is disposed transversely to the neck 26. Generally, the neck 26 provides an offset between the head 28 and the hooking section 22 of the elongated body 12 so that the head 28 defines a distal end of the implement 10.

In one embodiment, the head 28 is offset from the adjacent sidewall of hooking section 22 of the elongated body 12 by a distance $D_1$ within a range of about ½" to about 1" (other distances may be appropriate), measured parallel to the reference axis 30 (FIG. 2B). Generally, this offset allows the head 28 to be positioned a sufficient distance under an article in a manner that will be discussed in more detail below (e.g., to pull on an article using the head 28 versus the hooking section 22). In one embodiment, the head 28 is also offset from the handle 18 of the elongated body 12 by a distance $D_2$ within a range of about 2 inches to about 5 inches (other distances may be appropriate), measured transversely to the reference axis 30. This provides a desired center of gravity for the implement 10 (e.g., the handle 18 is disposed laterally between the head 28 and the second intermediate section 21 of the body 12 as noted above). It should be appreciated that the elongated body 12 could be of other configurations and yet still realize this offset relation between the head 28 and the handle 18 of the elongated body 12.

The adaptor 24 also includes a rear projection or extension 29 in the illustrated embodiment. This rear extension 29 proceeds beyond the adjacent sidewall of the hooking section 22 in the opposite direction of the neck 26. In one embodiment, the rear extension 29 proceeds about ⅛ inch beyond the sidewall of the hooking section 22. Other distances may be appropriate. The head 28 and rear extension 29 are thereby on opposite sides of the hooking section 22. The rear extension 29 is used when the hooking section 22 is positioned behind an article to pull on the same with the implement 10. Generally the rear extension 29 focuses the force that the implement 10 exerts on an article when pulling the same by positioning the hooking section 22 behind the article relative to where the user of the implement 10 is positioned.

Figure 3A:
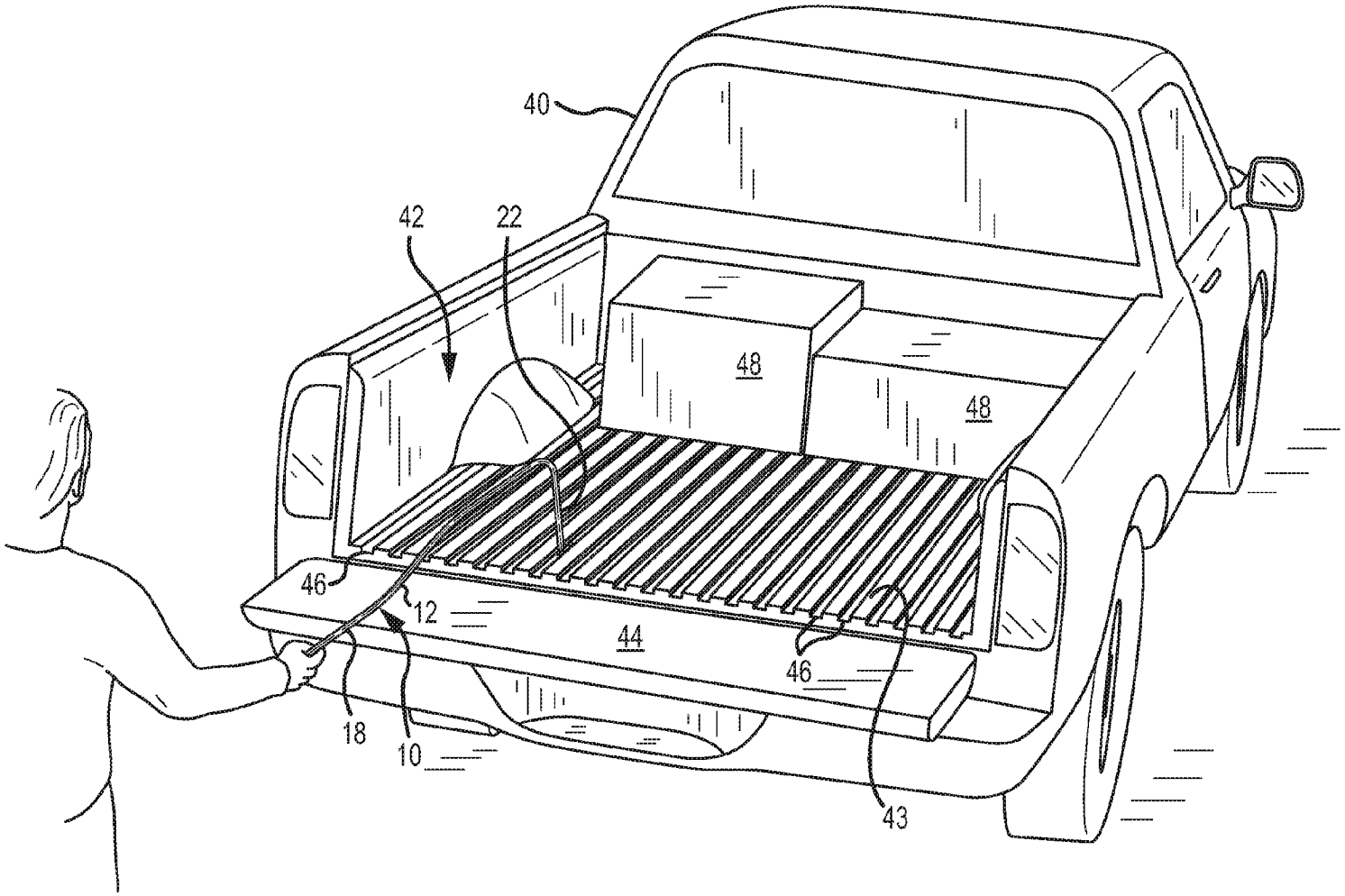
FIG. 3A is a perspective view illustrating the sliding of the head of the implement of FIG. 1 along a groove associated with a pickup box for retrieving an article.

The implement 10 may be used to move articles within a pickup box in a variety of manners. One representative way is illustrated in relation to FIGS. 3A-C. FIG. 3A illustrates a pickup 40 that has a pickup box 42 with a bed 43, as well as a tailgate 44 for providing access to the pickup box 42. A plurality of grooves 46 are associated with the bed 43 of the pickup box 42. For instance, the grooves 46 may be integrally formed with or be part of the bed 43 of the pickup box 42. Another option is for the grooves 46 to be part of a separate bedliner that is disposed within the pickup box 42. In any case, the grooves 46 extend along the length of the pickup box 42.

Figure 3B:
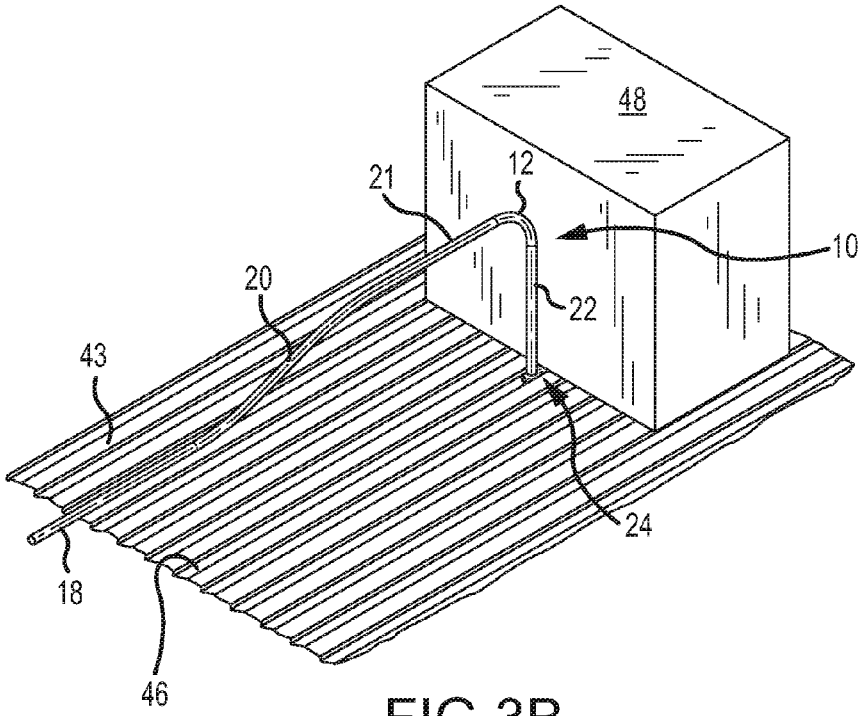
FIG. 3B is a perspective view illustrating the head of the implement of FIG. 1 having been slid along a groove so as to be positioned under an article in the pickup box.
Figure 3C:
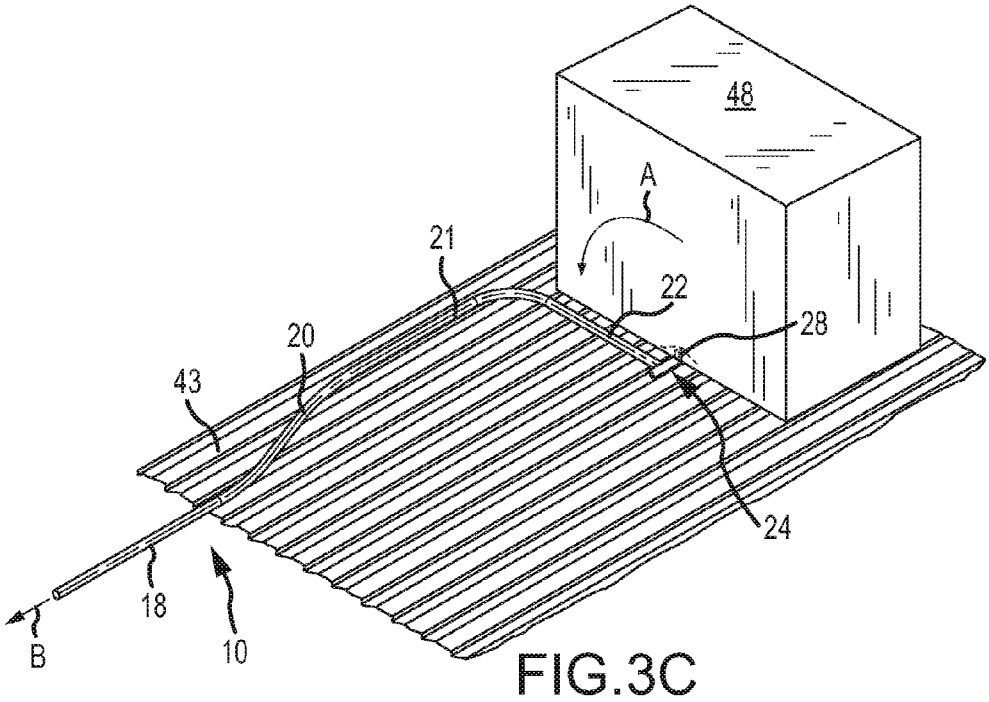
FIG. 3C is a perspective view after having rotated the implement of FIG. 1 from the position illustrated in FIG. 3B and into a representative position for pulling the article along the bed of the pickup box.

FIG. 3A illustrates a pair of articles or boxes 48 (e.g., cardboard) that are within the pickup box 42 next to the cab. In this case or in case where the hooking section 22 of the implement 10 cannot otherwise be positioned behind the desired article in the pickup box 42 for any reason, the head 28 of the implement 10 may be directed into an appropriate groove 46 and with the implement 10 being in an at least generally upright position. Although FIG. 3A illustrates the handle 18 of the implement 10 being disposed at the same general elevation as the bed 43 of the pickup box 42 at this time, such is not required. For instance, the handle 18 could be disposed at a higher elevation than the bed 43 of the pickup box 42 (not shown) while sliding the head 28 along the relevant groove 46 (e.g., "tipping" the upper portion of the hooking section 22 in FIG. 3A generally in the direction of the boxes 48). In any case, the implement 10 may then be advanced a sufficient distance along the relevant groove 46 to slide the head 28 along the groove 46 until the head 28 is positioned under the desired box 48 or other article, and with the hooking section 22 being positioned at least generally adjacent to the desired box 48 (FIG. 3B). It should be appreciated that the head 28 could contact the underside of the box 48 while being slid under the box 48. Having the hooking section 22 of the implement 10 being disposed at least generally perpendicular to the bed 43 of the pickup box 42 at this time allows the head 28 to be disposed further under the desired box 48 for the illustrated configuration of the implement 10. This may not be the case for other configurations. Once the head 28 is positioned a sufficient distance under the relevant box 48, the implement 10 may be rotated to direct the head 28 into an increased engagement with the box 48 (e.g., in the direction of the arrow A in FIG. 3C, or in the opposite direction). Stated another way, the rotation of the implement 10 establishes a mechanical purchase between the head 48 and the underside of the box 48 that is sufficient to allow the implement 10 to pull the box 48 along the bed 43. This rotation of the implement 10 may deflect the bottom of the box 48 to a degree as shown by the dashed lines in FIG. 3C. FIG. 3C illustrates rotating the implement 10 to a prone position to establish a "mechanical purchase" between the head 28 and the box 48. It should be appreciated that the implement 10 could be rotated through a smaller range of motion and still establish the noted mechanical purchase between the head 28 and the relevant box 48. In any case, the user can then simply pull on the implement 10 in the direction of the arrow B to slide the box 48 along the bed 43 of the pickup box 42 to a position where it may be more readily accessed for removal from the pickup box 42. In this case the head 28 coincides with where the forces of the implement 10 are focused on the box 48. A variation of this approach would be to pull the box 48 along the bed 43 of the pickup box 42 in the above-described manner (with the head 28 underneath the box 48) until there is a certain space between the box 48 and the cab of the pickup and/or until the box 48 is sufficiently closer to the tailgate 44. Thereafter, the implement 10 may be rotated back to a position where the head 28 can be withdrawn out from underneath the box 48 (e.g., back to the FIG. 3B position), such that the user may position the hooking section 22 of the implement 10 behind the box 48 and thereafter continue pulling the box 48 along the bed 43 of the pickup box 42 with the hooking section 22 of the implement 10 engaging the back side of the box 48.

Figure 3D:
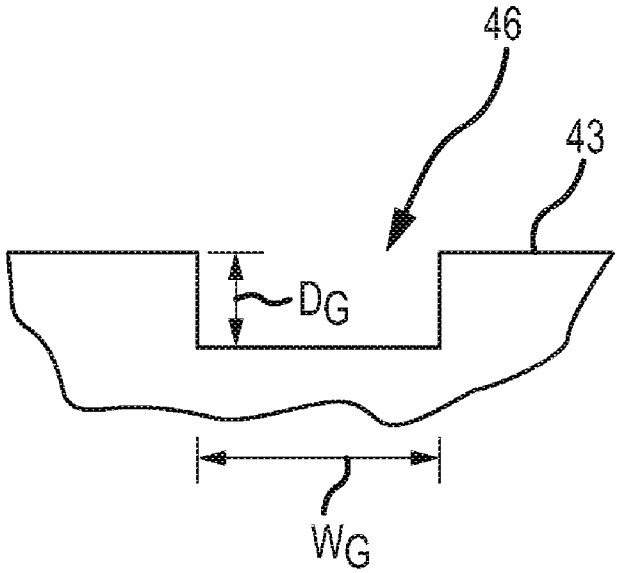
FIG. 3D is an end view of one of the grooves in the bed of the pickup box.

Based upon the foregoing, the head 28 of the implement 10 facilitates the movement of articles within a pickup box or along any other appropriate surface having one or more grooves. In one embodiment: 1) the width of the head 28 (dimension "$W_H$" in FIG. 2A) is no more than the width of the groove in which the head 28 is to be positioned (e.g., dimension "$W_G$" in FIG. 3D), and preferably is at least slightly less than this groove width; 2) the thickness of the head 28 (dimension "T" in FIG. 2A) is no more than the depth of the groove in which the head 28 is to be positioned (e.g., dimension "$D_G$" in FIG. 3D); and 3) the width of the head 28 (dimension "$W_H$" in FIG. 2A) is greater than the depth of the groove in which the head 28 is to be positioned (e.g., dimension "$D_G$" in FIG. 3D). This combination of features allows the head 28 to be positioned under the box 48 in the pickup box 42, allows the implement 10 to be rotated to bring the head 28 into engagement with the underside of this box, and thereafter allows the implement 10 to be pulled to move the box 48 along the bed 43 of the pickup box 42 through an engagement between the head 28 and the underside of the box 48.

There are other characterizations that may be made in relation to how the head 28 may be used to move a box 48 along the bed 43 of the pickup box 42. One is that with the head 28 being in a first position, the head 28 may be slid along one of the grooves 46 to a position that is underneath a box 48. The head 28 may then be moved to a second position to establish sufficient contact with the box 48 to allow the box 48 to move along the bed 43 of the pickup box 42 by pulling on the implement 10 (with the head 28 maintaining contact with the underside of the box 48). Yet another characterization is that the head 28 has a first vertical profile when it is positioned under the box 48 by advancing along one of the grooves 46, and it has an enhanced or larger second vertical profile when the implement 10 is rotated so as to establish sufficient contact with the box 48 to allow the box 48 to move along the bed 43 of the pickup box 42 by pulling on the implement 10 (with the head 28 maintaining contact with the underside of the box 48).

Another option for using the implement 10 to retrieve a box 48 from the pickup box 42 is to simply initially position the hooking section 22 of the implement 10 behind the desired box 48 or other article. The intermediate sections 20, 21 could be disposed over the box 48 or alongside the box 48 or other article. With the hooking section 22 engaging the back side of the box 48, the user can then simply pull on the implement 10 to move the box 48 or other article along the bed 43 of the pickup box 42 to a desired position. As noted above, having the angle $\theta_2$ (the angle between the hooking section 22 and the second intermediate section 21) be less than 90° facilitates the transmission of forces from the implement 10 to the box 48. Moreover, having a rear extension 29 for the adapter 24 provides an enhanced "mechanical purchase" between the implement 10 and the box 48. Using both of these features in combination focuses the forces being transmitted from the implement 10 to the box 48 while using the implement 10 to pull the box 48 by having the hooking section 22 be positioned behind the box 48.

The implement 10 is by no means limited to the application of retrieving a box 48 from within a pickup box 42. The implement 10 may be used to retrieve any appropriate article from within a pickup box 42 (e.g., bags of groceries, duffel bags, hockey bags). The implement 10 may also be useful to simply change the position of an article within a pickup box 42. For instance, the hooking section 22 of the implement 10 may be used to push an article within a pickup box 42 to a new position. One or both of the intermediate sections 20, 21 could be used to move an article within a pickup box 42 in a sideways fashion (e.g., by positioning the second intermediate section 21 along the side of an article). Generally, the implement 10 may be used in any appropriate manner to manipulate an article (e.g., change the position of an article) within a pickup box 42. In fact, the implement 10 may be used in any appropriate manner to manipulate any appropriate article (e.g., change the position of an article) on any appropriate surface. For instance, the implement 10 may also be useful for manipulating an article within the cargo area of a sports utility vehicle. The carpeted surface in the cargo area of a sports utility vehicle should even be sufficiently compressible to allow the head 28 to be positioned under an article in the manner described above with regard to FIGS. 3A-C.

Figure 4:
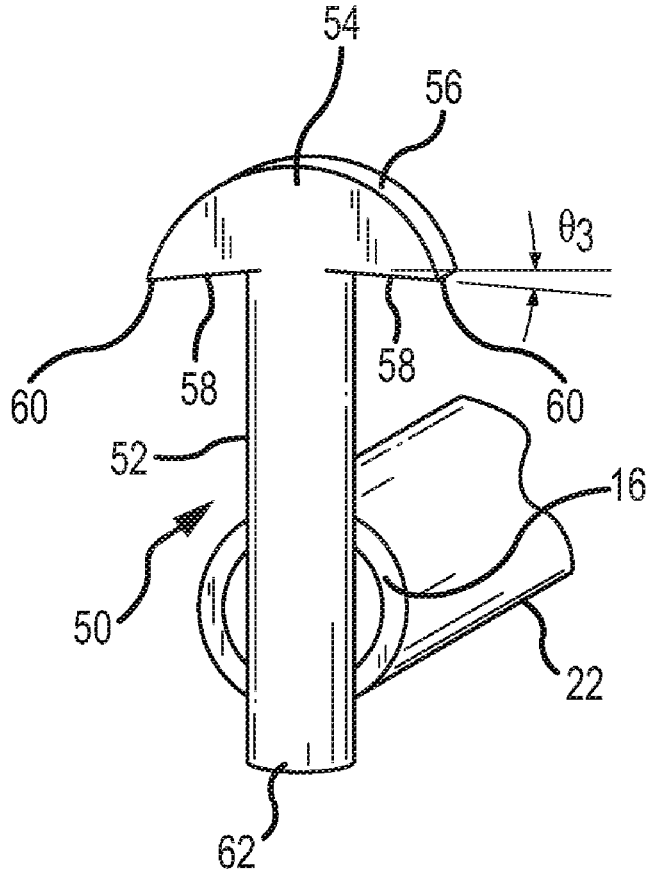
FIG. 4 is a perspective view of an adaptor having another embodiment of a head that may be used by the implement of FIGS. 1 and 6.

It should be appreciated that the configuration of the head 28 used by the implement 10 could be modified in a manner that still allows the head 28 to be the positioned under an article to pull the article along an appropriate surface. Another such embodiment is illustrated in FIG. 4 in the form of an insert, plug, or adaptor 50 that is disposed within the open end 16 of the hooking section 22 of the elongated body 12. The adaptor 50 includes a neck 52 and a rear extension 62 that are in accordance with the neck 26 and rear extension 29 of the adapter 24 discussed above. Therefore, the principal difference between the embodiments shown in FIGS. 4 and 2A is in relation to the configuration of the head. In the case of the adaptor 50 of FIG. 4, the head 54 may be characterized as being at least generally semi-circular in shape in plan view. In this regard, the head 54 includes an arcuately-shaped front wall 56 and a pair of planar rear wall segments 58. Instead of the rear wall segments 58 being disposed transversely to the neck 52 (more specifically its length dimension), the rear wall segments 58 extend from the end of the neck 52 back toward the hooking section 22. That is, the rear wall segments 58 are disposed at an angle $\theta_3$ relative to a reference plane that is orthogonal to the length dimension of the neck 52. In the illustrated embodiment, the angle $\theta_3$ is about 5°. Other angles may be appropriate. Generally, this orientation of the rear wall segments 58 defines an edge 60 that further focuses the transmission of forces from the head 54 to the engaged article when the head 54 is positioned beneath the article and rotated to establish a desired mechanical purchase.

Yet another embodiment of a head is illustrated in FIGS. 5A-D in the form of an insert, plug, or adaptor 70 that is disposed within the open end 16 of the hooking section 22 of the elongated body 12. The adaptor 70 includes a neck 72 and a rear extension 82 that are at least generally in accordance with the neck 26 and rear extension 29 of the adapter 24 discussed above (although of a different shape/configuration) . Therefore, the principal difference between the embodiments shown in FIGS. 5A-D and 2A is in relation to the configuration of the head. In the case of the adaptor 70 of FIGS. 5A-D, the head 74 again may be characterized as being at least generally semi-circular in shape in plan view. In this regard, the head 74 includes an arcuately-shaped front wall 76 and a pair of planar rear wall segments 78. The head 74 also includes a chamfered bottom wall 77 that may facilitate sliding the head 74 along a surface that is supporting an article to be moved.

Figure 5A:
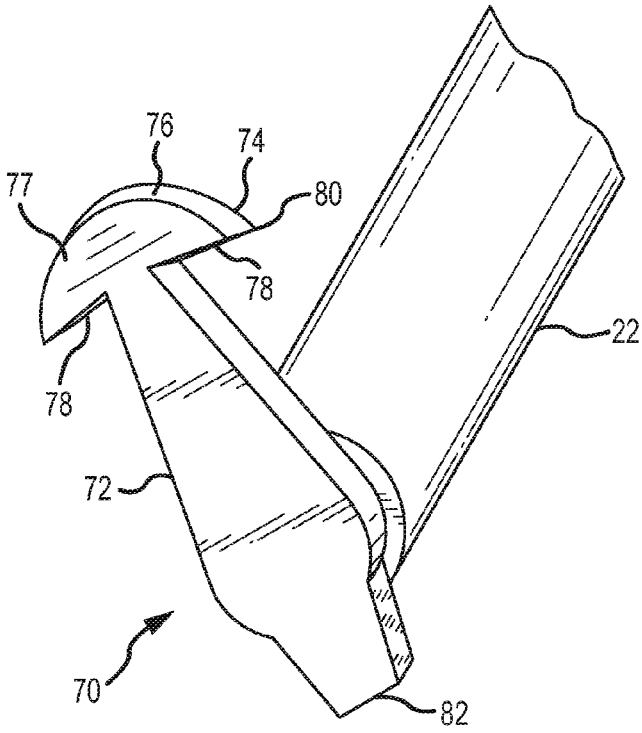
FIG. 5A is a perspective view of an adaptor having another embodiment of a head that may be used by the implement of FIGS. 1 and 6.
Figure 5B:
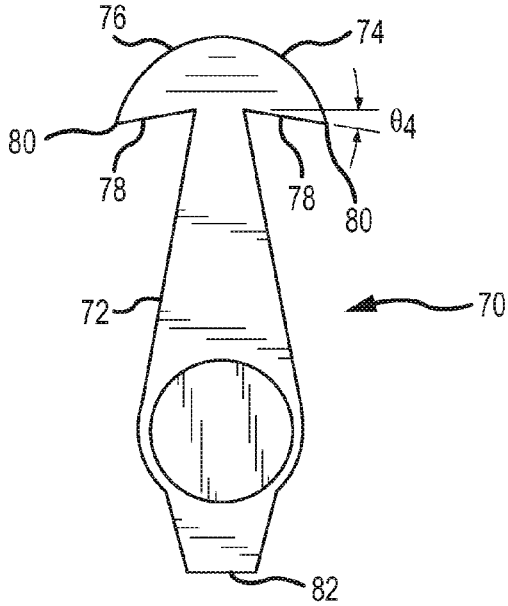
FIG. 5B is a top view of the adaptor illustrated in FIG. 5A.
Figure 5C:
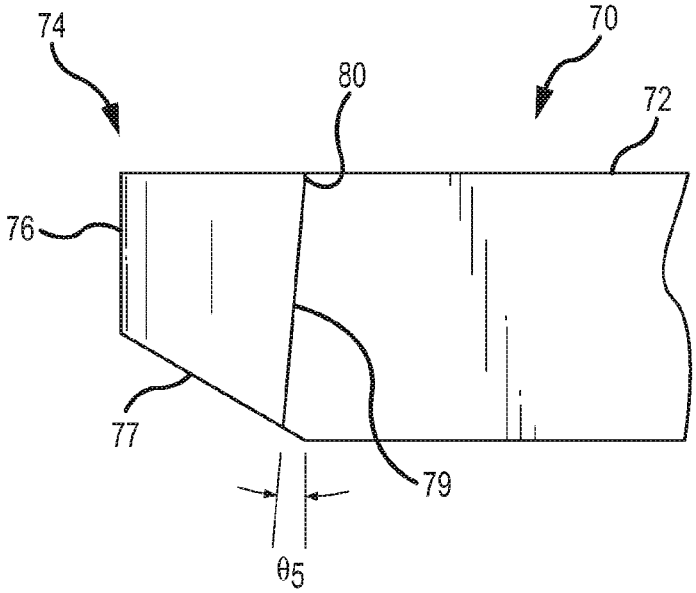
FIG. 5C is a side view of the adaptor illustrated in FIG. 5A.
Figure 5D:
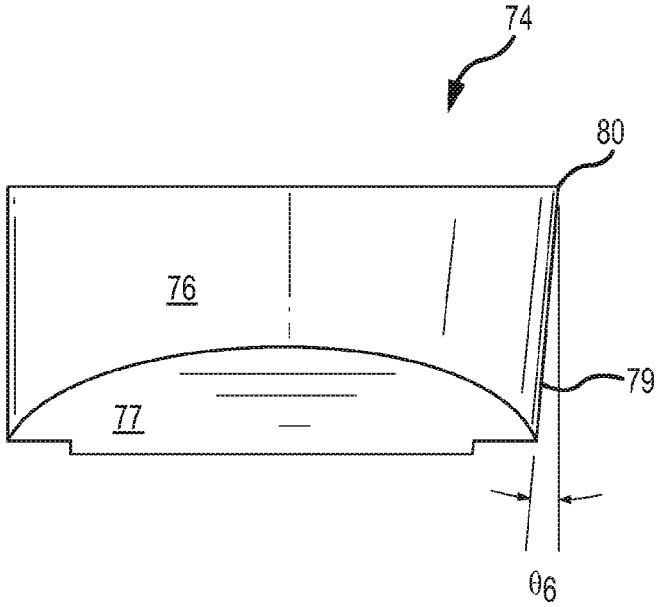
FIG. 5D is a front end view of the adaptor illustrated in FIG. 5A.

Instead of the rear wall segments 78 being disposed transversely to the neck 72 (more specifically its length dimension), the rear wall segments 78 extend from the end of the neck 72 back toward the hooking section 22. That is, the rear wall segments 78 are disposed at an angle $\theta_4$ (FIG. 5B) relative to a reference plane that is orthogonal to the length dimension of the neck 72. In the illustrated embodiment, the angle $\theta_4$ is about 5°. Other angles may be appropriate. The rear wall segments 78 also extend at an angle from an upper edge to a lower edge, with the lower edge of the rear wall segments 78 "leading" the upper edge of the rear wall segments 78 by a certain amount (FIG. 5C). Therefore, the edge 79 defined by the intersection of curved front wall 76 and each rear wall segment 78 is disposed at an angle $\theta_5$. In the illustrated embodiment, the angle $\theta_5$ is about 5° (FIG. 5C). Other angles may be appropriate. Finally, the rear wall segments 78 also extend at an angle from an upper edge to a lower edge, with the upper edge of the rear wall segments 78 being further from the center of the head 74 than the lower edge of the rear wall segments 78 by a certain amount (FIG. 5D). Therefore, each edge 79 is also disposed at an angle $\theta_6$. In the illustrated embodiment, the angle $\theta_6$ is about 5° (FIG. 5D). Other angles may be appropriate. Generally, this orientation of the rear wall segments 78 defines a point 80 that further focuses the transmission of forces from the head 74 to the engaged article when the head 74 is positioned beneath the article and rotated to establish a desired mechanical purchase.

Figure 6:
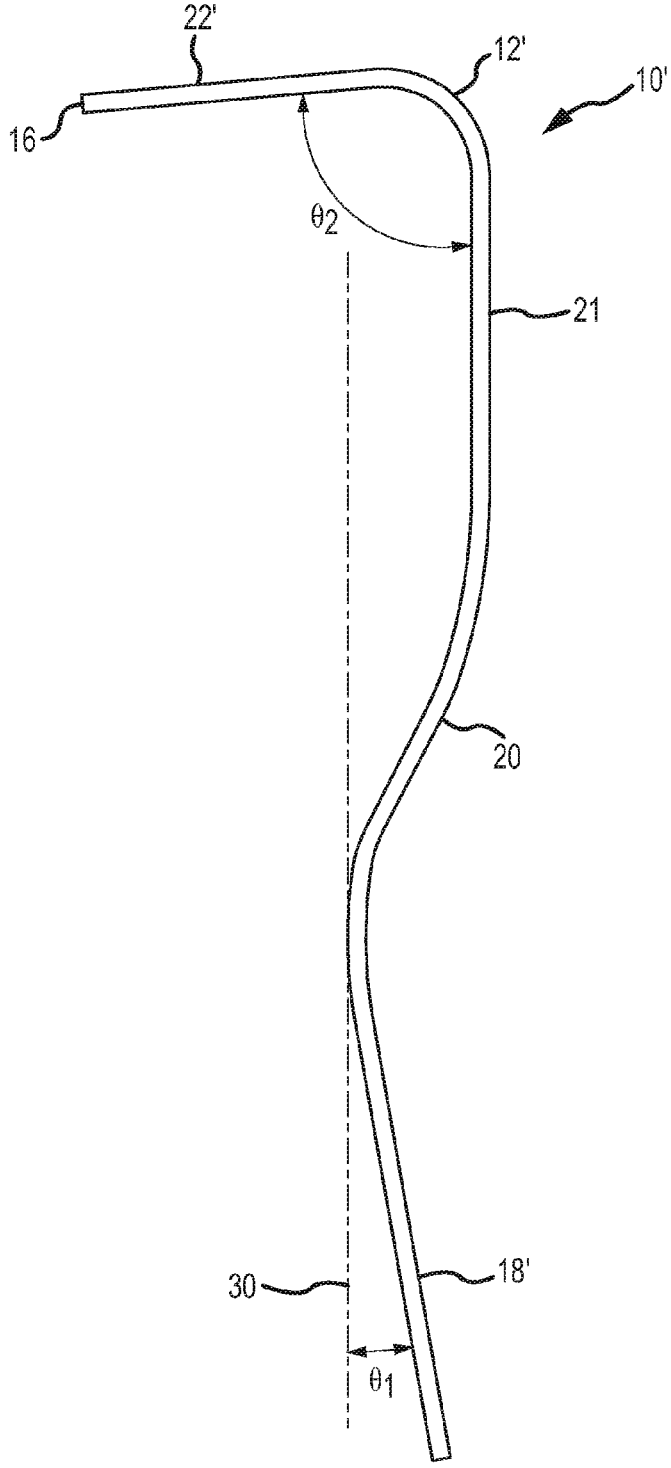
FIG. 6 is a variation of the implement of FIG. 1.

FIG. 6 illustrates a variation of the implement 10 that is illustrated in FIGS. 1-3C. Corresponding components between the two embodiments are identified by the same reference numeral. Those components in the FIG. 6 embodiment that differ from the FIG. 1 embodiment are further identified by a "single prime" designation. The implement 10' of FIG. 6 differs from the implement 10 of FIG. 1 on a number of grounds. One is that the implement 10' is shown without any adaptor. However, any of the adaptors 24, 50, 70 discussed herein may be used with the implement 10'. Another difference is that the angle $\theta_2$ between the hooking section 22' and the second intermediate section 21 is less than 90°, and more specifically is about 85°. Yet another difference is that the angle $\theta_1$ between the handle 18' and the reference axis 30 is about 10°.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A method for moving a first object, comprising the steps of:

providing an implement that comprises an elongated body and a head disposed on a distal end of said elongated body, wherein said providing step comprises said elongated body comprising a handle, an intermediate section that extends from said handle and at least initially away from a first axis associated with said elongated body such that said intermediate section is disposed on a first side of said first axis, and a hooking section, wherein said intermediate section interconnects said handle and said hooking section, wherein said head is disposed on a second side of said first axis that is opposite of said first side, and wherein said handle is located between said intermediate section and said head in a lateral dimension that is orthogonal to said first axis;

sliding said head of said implement along a surface;

directing said head of said implement under a first object using said sliding step;

executing a first rotating step comprising rotating said implement after said head is under said first object, wherein said first rotating step comprises reorienting said head and providing an increased engagement between said head and an underside of said first object; and executing a first pulling step comprising pulling said implement to move said first object along said surface, wherein said first pulling step is executed after said first rotating step and while said head remains engaged with said underside of said first object.

2. The method of claim 1, wherein said first object is a cardboard box.

3. The method of claim 1, wherein said providing step comprises said implement comprising an at least generally T-shaped structure, and wherein said head defines a distal end of said at least generally T-shaped structure.

4. The method of claim 1, wherein an angle between said implement and said surface is larger for said sliding step compared to said first pulling step.

5. The method of claim 1, wherein said providing step comprises said head of said implement being disposed beyond an end of said elongated body.

6. The method of claim 1, wherein said providing step comprises said elongated body being in the form of a shaped tube.

7. The method of claim 1, wherein said providing step comprises said hooking section being disposed at least generally transversely to a length dimension of said elongated body, and wherein said head is disposed beyond said hooking section to define a distal end of said implement.

8. The method of claim 1, wherein said providing step further comprises said hooking section being disposed at least generally transversely to said first axis.

9. The method of claim 1, wherein said providing step further comprises said head and said handle being offset by a distance within a range of about 2 inches to about 5 inches that is measured transversely to said first axis.

10. The method of claim 1, wherein said providing step further comprises said implement further comprising a neck that extends from said hooking section, wherein said head is disposed on an end of said neck, and wherein said head is wider than said neck.

11. The method of claim 1, wherein said providing step further comprises said implement further comprising a neck that extends from said hooking section, wherein said head is disposed on an end of said neck, and wherein said head is at least substantially transversely disposed relative to neck.

12. The method of claim 1, further comprising the steps of:

executing a second rotating step comprising rotating said implement, wherein said second rotating step is executed after a termination of said first pulling step;

withdrawing said head from underneath said first object after said second rotating step;

positioning said hooking section behind said first object after said withdrawing step; and executing a second pulling step comprising pulling said first object using an engagement between said hooking section and a back side of said first object.

13. The method of claim 1, wherein said surface is a pickup box bed that comprises a plurality of grooves, wherein said method further comprises the step of positioning said head of said implement within a first groove of said plurality of grooves, wherein said sliding step, said directing step, said first rotating step, and at least part of said pulling step are executed with said head remaining in said first groove.

14. The method of claim 1, wherein said first rotating step comprises deflecting said underside of said first object to provide said increased engagement between said head and said underside of said first object.

15. The method of claim 1, where said first pulling step is executed during said providing an increased engagement step.

16. The method of claim 1, wherein said head extends a first distance above said surface during said sliding step, wherein said head extends a second distance above said surface after said first rotating step, wherein said second distance is larger than said first distance.

17. The method of claim 1, wherein in response to said first rotating step, said head extends further from said surface during said pulling step compared to each of said sliding and directing steps.

18. The method of claim 1, wherein said providing step comprises said implement further comprising a second intermediate section that extends from said first intermediate section parallel to said first axis, wherein said hooking section is at least generally transversely disposed relative to said first axis, and wherein said head extends from a free end of said hooking section.

19. The method of claim 18, wherein said head extends from said hooking section parallel to said reference axis.

20. The method of claim 1, wherein said providing step comprises said elongated body further comprising a hooking section that is disposed at least generally transversely to a length dimension of said elongated body, and wherein said head is disposed beyond said hooking section to define a distal end of said implement.

21. A method for moving a first object, comprising the steps of:

providing an implement that comprises an elongated body and a head disposed on a distal end of said elongated body, wherein said providing step comprises said implement comprising an at least generally T-shaped structure, and wherein said head defines a distal end of said at least generally T-shaped structure;

sliding said head of said implement along a surface;

directing said head of said implement under a first object using said sliding step;

executing a first rotating step comprising rotating said implement after said head is under said first object, wherein said first rotating step comprises reorienting said head and providing an increased engagement between said head and an underside of said first object; and executing a first pulling step comprising pulling said implement to move said first object along said surface, wherein said first pulling step is executed after said first rotating step and while said head remains engaged with said underside of said first object.

22. The method of claim 21, wherein said first object is a cardboard box.

23. The method of claim 21, wherein an angle between said implement and said surface is larger for said sliding step compared to said first pulling step.

24. The method of claim 21, wherein said providing step comprises said head of said implement being disposed beyond an end of said elongated body.

25. The method of claim 21, wherein said providing step comprises said elongated body being in the form of a shaped tube.

26. The method of claim 21, wherein said surface is a pickup box bed that comprises a plurality of grooves, wherein said method further comprises the step of positioning said head of said implement within a first groove of said plurality of grooves, wherein said sliding step, said directing step, said first rotating step, and at least part of said pulling step are executed with said head remaining in said first groove.

27. The method of claim 21, wherein said first rotating step comprises deflecting said underside of said first object to provide said increased engagement between said head and said underside of said first object.

28. The method of claim 21, where said first pulling step is executed during said providing an increased engagement step.

29. The method of claim 21, wherein said head extends a first distance above said surface during said sliding step, wherein said head extends a second distance above said surface after said first rotating step, wherein said second distance is larger than said first distance.

30. The method of claim 21, wherein in response to said first rotating step, said head extends further from said surface during said pulling step compared to each of said sliding and directing steps.

31. A method for moving a first object, comprising the steps of:

providing an implement that comprises an elongated body and a head disposed on a distal end of said elongated body, wherein said providing step comprises said implement comprising a handle, a first intermediate section that extends from said handle at an angle relative to a reference axis, a second intermediate section that extends from said first intermediate section parallel to said reference axis, and a hooking section that is at least generally transversely disposed relative to said reference axis, wherein said head extends from a free end of said hooking section;

sliding said head of said implement along a surface;

directing said head of said implement under a first object using said sliding step;

executing a first rotating step comprising rotating said implement after said head is under said first object, wherein said first rotating step comprises reorienting said head and providing an increased engagement between said head and an underside of said first object; and executing a first pulling step comprising pulling said implement to move said first object along said surface, wherein said first pulling step is executed after said first rotating step and while said head remains engaged with said underside of said first object.

* * * * *